US009861140B2

(12) United States Patent
Wang et al.

(10) Patent No.: US 9,861,140 B2
(45) Date of Patent: Jan. 9, 2018

(54) ELECTRONIC CIGARETTE ATOMIZER WITH CONVENIENT-TO-MOUNT HEATING WIRE

(71) Applicants: Zhuhai Youde Technology Co., Ltd., Zhuhai, Guangdong (CN); Yiyu Cheng, Zhuhai, Guangdong (CN)

(72) Inventors: Litao Wang, Guangdong (CN); Feng Ouyang, Guangdong (CN); Yiyu Cheng, Guangdong (CN)

(73) Assignees: ZHUHAU YOUDE TECHNOLOGY CO., LTD., Zhuhai (CN); Yiyu Cheng, Zhuhai (CN)

( * ) Notice: Subject to any disclaimer, the term of this patent is extended or adjusted under 35 U.S.C. 154(b) by 0 days.

(21) Appl. No.: 15/155,176

(22) Filed: May 16, 2016

(65) Prior Publication Data

US 2017/0280770 A1 Oct. 5, 2017

(30) Foreign Application Priority Data

Mar. 31, 2016 (CN) ..... 2016 1 0196656

(51) Int. Cl.

| | |
|---|---|
| ***A24F 13/00*** | (2006.01) |
| ***A24F 47/00*** | (2006.01) |
| ***H05B 3/00*** | (2006.01) |
| ***H05B 3/42*** | (2006.01) |

(52) U.S. Cl.

CPC ..... *A24F 47/008* (2013.01); *H05B 3/0014* (2013.01); *H05B 3/42* (2013.01)

(58) Field of Classification Search

CPC ..... A24F 47/008

USPC ..... 131/329

See application file for complete search history.

(56) References Cited

U.S. PATENT DOCUMENTS

| | | | | |
|---|---|---|---|---|
| 4,947,874 | A * | 8/1990 | Brooks | A24F 47/008 128/202.21 |
| 8,511,318 | B2 * | 8/2013 | Hon | A24F 47/002 128/202.21 |
| 8,794,231 | B2 * | 8/2014 | Thorens | A24F 47/008 128/202.21 |
| 8,910,641 | B2 * | 12/2014 | Hon | A24F 47/002 128/202.21 |
| 9,301,547 | B2 * | 4/2016 | Liu | A24F 47/008 |
| 9,687,029 | B2 * | 6/2017 | Liu | H05B 3/16 |
| 2011/0303231 | A1 * | 12/2011 | Li | A24F 47/008 131/329 |

(Continued)

*Primary Examiner* — Tulsidas C Patel
*Assistant Examiner* — Peter G Leigh

(57) ABSTRACT

The disclosure relates to an electronic cigarette atomizer with a convenient-to-mount heating wire, which includes an oil storage atomization main body, a suction nozzle and a base. The base is provided with the heating wire and a heating wire fixing seat. More than two mounting holes are formed in an outer lateral surface of the heating wire fixing seat, more than two clamping blocks capable of moving up and down are arranged therein, and the clamping blocks are connected with the mounting holes in a one-to-one correspondence manner. Two ends of the heating wire are inserted into the mounting holes in the one-to-one correspondence manner, and are clamped and fixed under action of the clamping blocks. The electronic cigarette atomizer is simple and ingenious in structure, easy to product and machine and favorable for batch production.

6 Claims, 4 Drawing Sheets

(56) References Cited

U.S. PATENT DOCUMENTS

| | | | | |
|---|---|---|---|---|
| 2013/0192620 | A1* | 8/2013 | Tucker | H01C 17/00 131/329 |
| 2013/0192621 | A1* | 8/2013 | Li | H01C 17/00 131/329 |
| 2013/0192623 | A1* | 8/2013 | Tucker | H01C 17/00 131/329 |
| 2013/0213419 | A1* | 8/2013 | Tucker | A24F 47/008 131/328 |
| 2013/0319436 | A1* | 12/2013 | Liu | A24F 47/008 131/329 |
| 2013/0319438 | A1* | 12/2013 | Liu | A24F 47/008 131/329 |
| 2014/0041655 | A1* | 2/2014 | Barron | A61M 11/042 128/202.21 |
| 2014/0109921 | A1* | 4/2014 | Chen | A24F 47/008 131/273 |
| 2014/0130816 | A1* | 5/2014 | Liu | A24F 47/008 131/329 |
| 2014/0261408 | A1* | 9/2014 | Depiano | A24F 47/008 128/202.21 |
| 2014/0261495 | A1* | 9/2014 | Novak, III | A24F 47/008 131/329 |
| 2015/0034108 | A1* | 2/2015 | Newton | A61M 15/06 131/329 |
| 2015/0059787 | A1* | 3/2015 | Qiu | H05B 3/14 131/329 |

* cited by examiner

ELECTRONIC CIGARETTE ATOMIZER WITH CONVENIENT-TO-MOUNT HEATING WIRE

CROSS-REFERENCE TO RELATED APPLICATIONS

The present application claims the benefit of Chinese Patent Application No. 201610196656.4 filed on Mar. 31, 2016, the contents of which are hereby incorporated by reference.

TECHNICAL FIELD

The disclosure relates to the field of electronic cigarette atomizers, and in particular to an electronic cigarette atomizer with a convenient-to-mount heating wire for a lockset.

BACKGROUND

At present, heating wires and heating wire mounting seats are arranged in electronic cigarette atomizers on the market, but the heating wire mounting seats of these electronic cigarette atomizers are all screw or pole type mounting seats, that is, the heating wires are locked and fixed by screws or poles; and therefore, a screwdriver or a wrench is required to lock the screws and the poles to implement fixation of the heating wires when the heating wires are mounted and dismounted, which may cause higher complexity and time consumption in mounting and dismounting operation, serious influence on assembling efficiency and higher production cost.

SUMMARY

In order to solve the technical problem in a conventional art, the disclosure provides an electronic cigarette atomizer which may implement mounting and dismounting of a heating wire only by operating a hand operation part without any tool and is easy and convenient to operate, fast, safe, reliable, simple and ingenious in structure and easy to produce and machine.

In order to solve the technical problem, the disclosure adopts the following technical solution.

An electronic cigarette atomizer with a convenient-to-mount heating wire is provided, which includes an oil storage atomization main body, a suction nozzle and a base, wherein the suction nozzle and the base are arranged at front and rear ends of the oil storage atomization main body; the base is provided with the heating wire and a heating wire fixing seat, more than two mounting holes are formed in an outer lateral surface of the heating wire fixing seat, more than two clamping blocks capable of moving up and down are arranged therein, and the clamping blocks are connected with the mounting holes in a one-to-one correspondence manner; more than two hand operation parts are further arranged on the heating wire fixing seat, and the hand operation parts are in transmission connection with the clamping blocks, and control the clamping blocks to move up and down; and two ends of the heating wire are inserted into the mounting holes in the one-to-one correspondence manner, and are clamped and fixed under action of the clamping blocks.

Furthermore, clamping holes are formed in the clamping blocks, and the clamping holes are communicated with the mounting holes, and move up and down in the heating wire fixing seat along with the clamping blocks.

Furthermore, the hand operation parts are pulling keys, one end of each hand operation part is mounted on the heating wire fixing seat in a lever type rotating manner, and its end part is connected with a top of the corresponding clamping block; and resetting springs are further arranged in the heating wire fixing seat below each clamping block, and upper ends of the resetting springs are pressed against lower ends of the clamping blocks.

Furthermore, the heating wire fixing seat includes two parallel longitudinal fixing columns of which upper ends are open, the mounting holes are formed in its lateral surface, the clamping blocks are arranged therein, and the clamping blocks are columnar blocks; and the hand operation parts are mounted at openings in the upper ends of the fixing columns in the lever type rotating manner, and their lower ends are connected with the tops of the clamping blocks through the openings in the upper ends of the fixing columns.

Furthermore, the fixing columns and the mounting holes are integrated with the base.

Furthermore, the oil storage atomization main body includes a top cover, a linking sleeve, an oil storage pipe and a bottom cover, wherein the top cover and the linking sleeve are sequentially arranged at an upper end of the oil storage pipe from top to bottom, the bottom cover is arranged at a lower end of the oil storage pipe, its upper end is located in the oil storage pipe and provided with an atomization cavity, and the atomization cavity is communicated with an oil storage cavity in the oil storage pipe through a through hole formed in a peripheral surface of the bottom cover; a lower end of the linking sleeve is connected with the upper end of the bottom cover, and is communicated with the atomization cavity; the suction nozzle is arranged at an upper end of the top cover, and penetrates through the top cover to be communicated with the linking sleeve; and the base is arranged at a lower end of the bottom cover, and its heating wire and heating wire fixing seat are located in the atomization cavity of the bottom cover.

The disclosure has the beneficial effects that:

by the technical solution of the disclosure, the heating wire may be mounted and dismounted only by operating the hand operation parts without any tool, so that simplicity, convenience and high speed in operation, safety and reliability are ensured, production efficiency is greatly improved, cost is lowered, and the rate of qualified products is obviously increased; and moreover, the electronic cigarette atomizer is simple and ingenious in structure, easy to product and machine and favorable for batch production.

BRIEF DESCRIPTION OF THE DRAWINGS

The disclosure will be further described below with reference to the drawings and a specific embodiment.

DETAILED DESCRIPTION OF THE EMBODIMENTS

Figure 1:
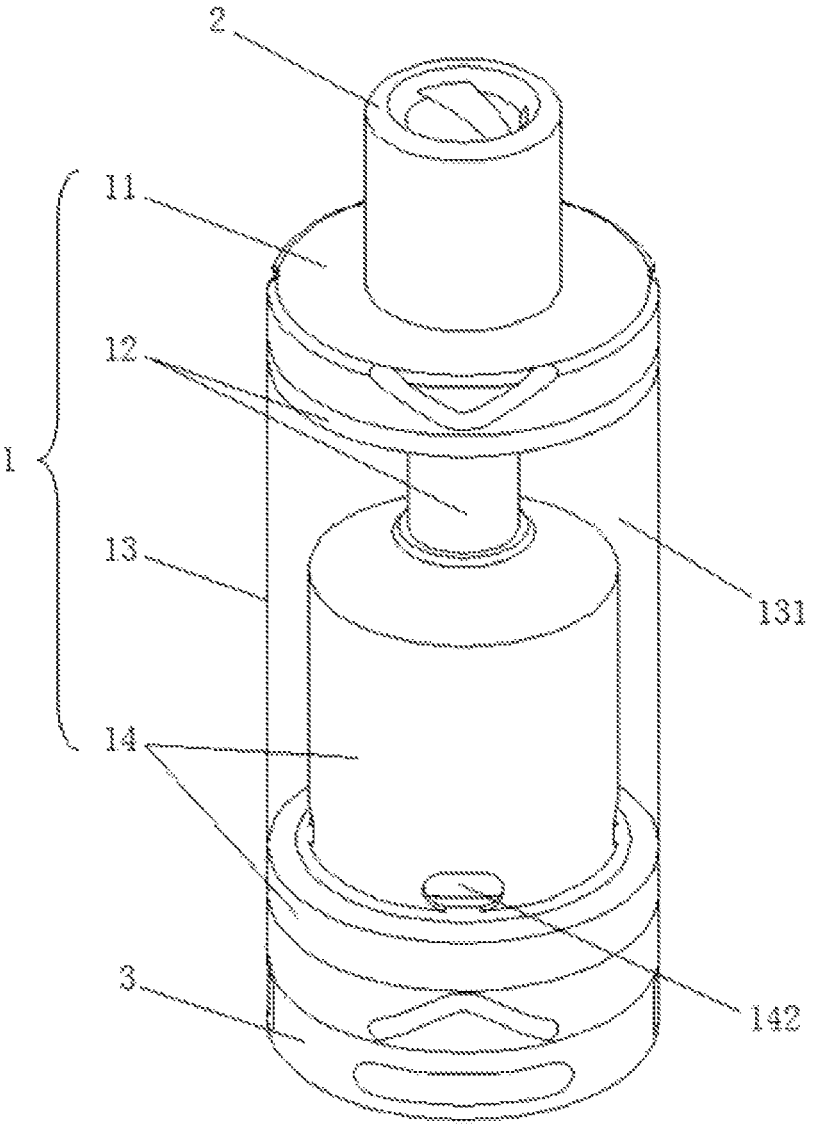
FIG. 1 is a structure diagram of an embodiment of an electronic cigarette atomizer with a convenient-to-mount heating wire according to the disclosure.
Figure 2:
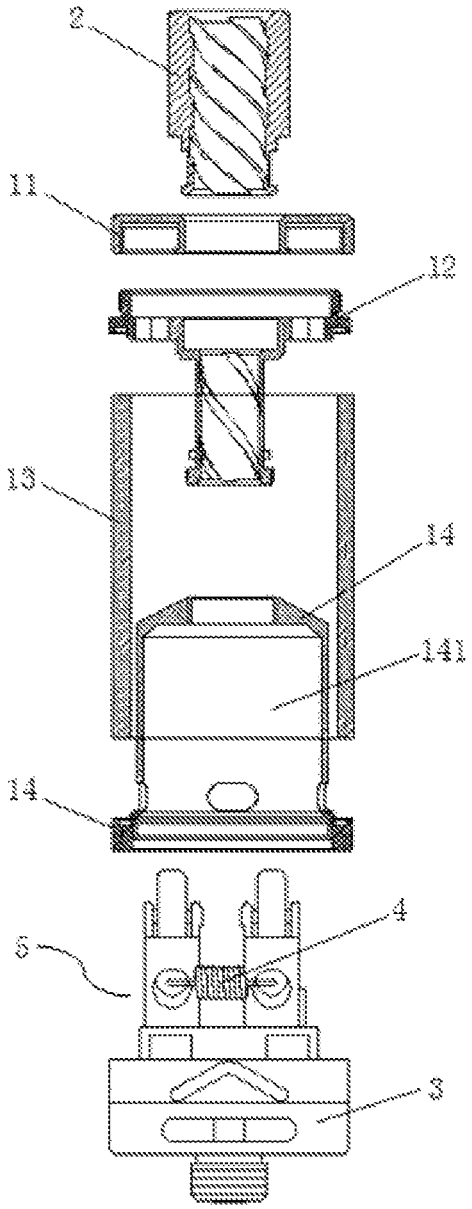
FIG. 2 is an exploded structure diagram of an embodiment of an electronic cigarette atomizer with a convenient-to-mount heating wire according to the disclosure.

In order to make a purpose, technical solution and advantage of the disclosure clearer, the disclosure will be further described below with reference to the drawings and the embodiment in detail. It should be understood that the specific embodiment described here is only adopted to explain the disclosure and not intended to limit the disclosure.

As shown in FIG. 1 to FIG. 5:

the embodiment of the disclosure provides an electronic cigarette atomizer with a convenient-to-mount heating wire, which includes an oil storage atomization main body 1, a suction nozzle 2 and a base 3, wherein the suction nozzle 2 and the base 3 are arranged at front and rear ends of the oil storage atomization main body 1. The base 3 is provided with the heating wire 4 and a heating wire fixing seat 5, more than two mounting holes 51 are formed in an outer lateral surface of the heating wire fixing seat 5, more than two clamping blocks 52 capable of moving up and down are arranged therein, and the clamping blocks 52 are connected with the mounting holes 51 in a one-to-one correspondence manner; more than two hand operation parts 54 are further arranged on the heating wire fixing seat 5, and the hand operation parts 54 are in transmission connection with the clamping blocks 52, and control the clamping blocks 52 to move up and down; and two ends of the heating wire 4 are inserted into the mounting holes 51 in the one-to-one correspondence manner, and are clamped and fixed under action of the clamping blocks 52.

Figure 3:
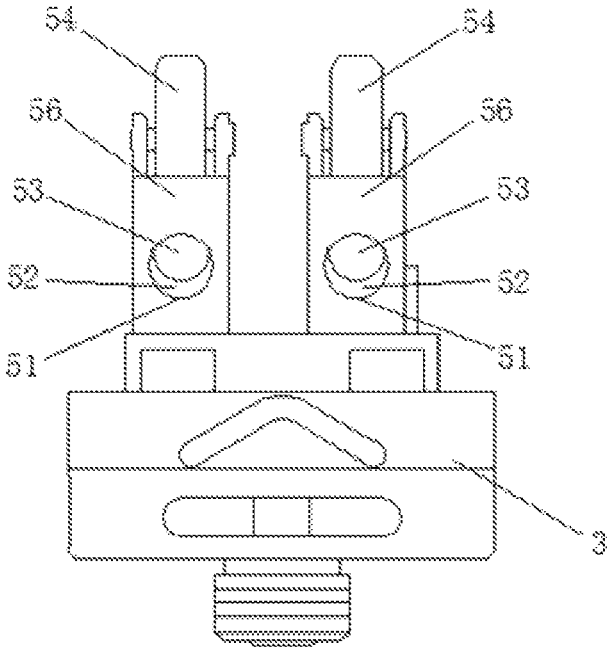
FIG. 3 is a structure diagram of a base after pulling keys are pulled upwards in an embodiment of an electronic cigarette atomizer with a convenient-to-mount heating wire according to the disclosure.
Figure 4:
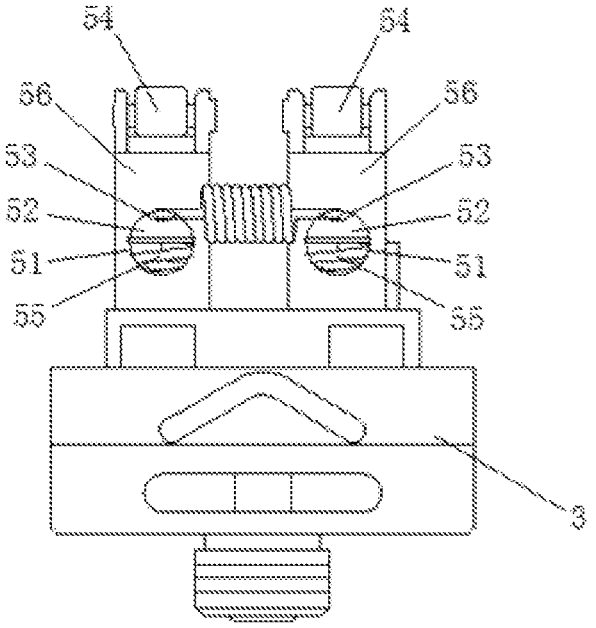
FIG. 4 is a structure diagram of a base after pulling keys are pulled downwards and a heating wire is fixed in an embodiment of an electronic cigarette atomizer with a convenient-to-mount heating wire according to the disclosure.
Figure 5:
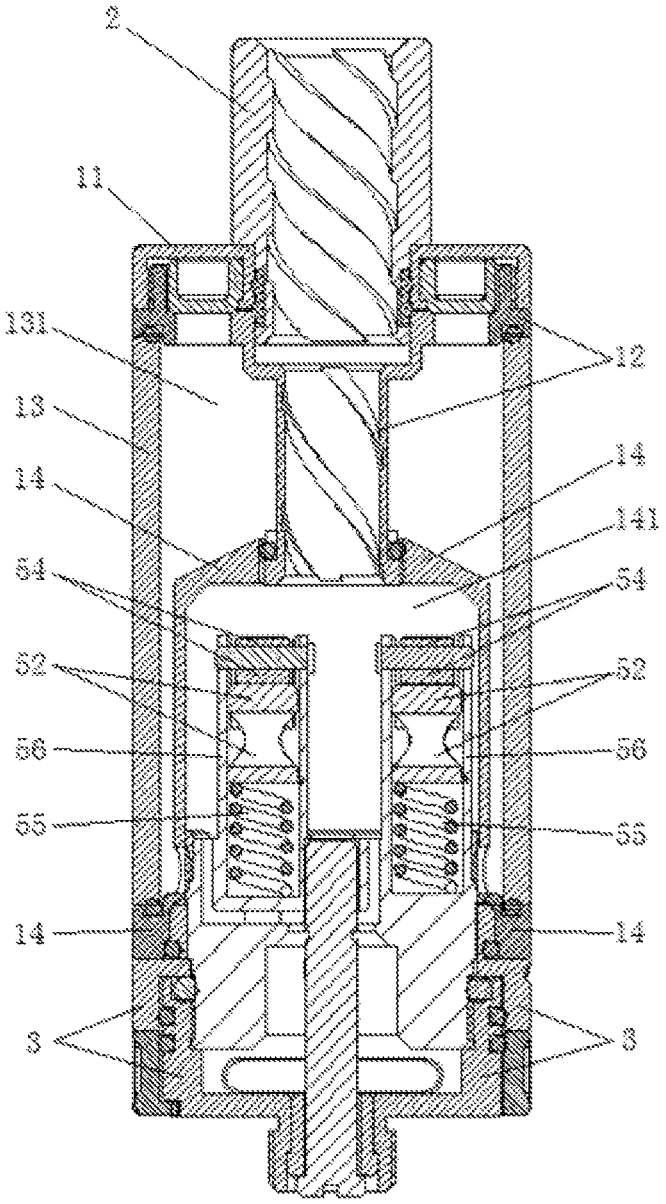
FIG. 5 is a profile chart of an embodiment of an electronic cigarette atomizer with a convenient-to-mount heating wire according to the disclosure.

A specific structure may be as follows: the oil storage atomization main body 1 includes a top cover 11, a linking sleeve 12, an oil storage pipe 13 and a bottom cover 14, wherein the top cover 11 and the linking sleeve 12 are sequentially arranged at an upper end of the oil storage pipe 13 from top to bottom, the bottom cover 14 is arranged at a lower end of the oil storage pipe 13, its upper end is located in the oil storage pipe 13 and provided with an atomization cavity 141, and the atomization cavity 141 is communicated with an oil storage cavity 131 in the oil storage pipe 13 through a through hole 142 formed in a peripheral surface of the bottom cover 14; a lower end of the linking sleeve 12 is connected with the upper end of the bottom cover 14, and is communicated with the atomization cavity 141; the suction nozzle 2 is arranged at an upper end of the top cover 11, and penetrates through the top cover 11 to be communicated with the linking sleeve 12; and the base 3 is arranged at a lower end of the bottom cover 14, and its heating wire 4 and heating wire fixing seat 5 are located in the atomization cavity 141 of the bottom cover 14. The heating wire fixing seat 5 includes two parallel longitudinal fixing columns 56 of which upper ends are open, the mounting holes 51 are formed in its lateral surface, and the fixing columns 56 and the mounting holes 51 are integrated with the base 5; and the clamping blocks 52 are arranged in the heating wire fixing seat 5, the clamping blocks 52 may be columnar blocks, clamping holes 53 are formed therein, and the clamping holes 53 are communicated with the mounting holes 51, and move up and down in the heating wire fixing seat 5 along with the clamping blocks 52. The hand operation parts 54 are mounted at openings in the upper ends of the fixing columns 56 in a lever type rotating manner, and their lower ends are connected with tops of the clamping blocks 52 through the openings in the upper ends of the fixing columns 56; as shown in FIGS. 3 and 4, the hand operation parts 54 may be pulling keys, one end of each hand operation part is mounted on the heating wire fixing seat 5 in the lever type rotating manner, and its end part is connected with the top of the corresponding clamping block 52; and resetting springs 55 are further arranged in the heating wire fixing seat 5 below each clamping block 52, and upper ends of the resetting springs 55 are pressed against lower ends of the clamping blocks 52.

In the disclosure, when the heating wire of the electronic cigarette atomizer is mounted, only the hand operation parts 54 are required to be operated to enable the clamping blocks 52 to move up and down to clamp and fix the heating wire 4 inserted into the mounting holes 51, specifically as follows: the pulling keys are pulled upwards to make their end parts act on the tops of the clamping blocks 52 to drive the clamping blocks 52 to move downwards and connect the clamping holes 53 with the mounting holes 51, then ends of the heating wire 4 are inserted into the mounting holes 51 and the clamping holes 53, the pulling keys are pulled downwards, and the clamping blocks 52 move upwards under the action of the resetting springs 55 to dislocate the clamping holes 53 and the mounting holes 51 and clamp the ends of the heating wire 4 through inner sidewalls of the clamping holes 53 and inner sidewalls of the mounting holes 51 to fix the heating wire 4.

In such a manner, the heating wire 4 of the electronic cigarette atomizer of the disclosure may be simply, conveniently and fast mounted and dismounted without any tool, production efficiency is greatly improved, cost is reduced, safety and reliability are ensured, and the rate of qualified products is obviously increased; and moreover, the electronic cigarette atomizer is simple and ingenious in structure, easy to produce and machine and favorable for batch production.

The above is the preferred implementation mode of the disclosure, it is important to point out that those skilled in the art may further make a plurality of improvements and embellishments without departing from the principle of the disclosure, and these improvements and embellishments shall fall within the scope of protection of the disclosure.

The invention claimed is:

1. An electronic cigarette atomizer with a convenient-to-mount heating wire, comprising an oil storage atomization main body (1), a suction nozzle (2) and a base (3), the suction nozzle (2) and the base (3) being arranged at front and rear ends of the oil storage atomization main body (1), wherein the base (3) is provided with the heating wire (4) and a heating wire fixing seat (5), more than two mounting holes (51) are formed in an outer lateral surface of the heating wire fixing seat (5), more than two clamping blocks (52) capable of moving up and down are arranged therein, and the clamping blocks (52) are connected with the mounting holes (51) in a one-to-one correspondence manner; more than two hand operation parts (54) are further arranged on the heating wire fixing seat (5), and the hand operation parts (54) are in transmission connection with the clamping blocks (52), and control the clamping blocks (52) to move up and down; and two ends of the heating wire (4) are inserted into the mounting holes (51) in the one-to-one correspondence manner, and are clamped and fixed under action of the clamping blocks (52).

2. The electronic cigarette atomizer with the convenient-to-mount heating wire according to claim 1, wherein clamping holes (53) are formed in the clamping blocks (52), and the clamping holes (53) are communicated with the mounting holes (51), and move up and down in the heating wire fixing seat (5) along with the clamping blocks (52).

3. The electronic cigarette atomizer with the convenient-to-mount heating wire according to claim 2, wherein the hand operation parts (54) are pulling keys, one end of each hand operation part is mounted on the heating wire fixing seat (5) in a lever type rotating manner, and its end part is connected with a top of the corresponding clamping block (52); and resetting springs (55) are further arranged in the heating wire fixing seat (5) below each clamping block, and upper ends of the resetting springs (55) are pressed against lower ends of the clamping blocks (52).

4. The electronic cigarette atomizer with the convenient-to-mount heating wire according to claim 1, wherein the heating wire fixing seat (5) comprises two parallel longitudinal fixing columns (56) of which upper ends are open, the mounting holes (51) are formed in its lateral surface, the clamping blocks (52) are arranged therein, and the clamping blocks (52) are columnar blocks; and the hand operation parts (54) are mounted at openings in the upper ends of the fixing columns (56) in the lever type rotating manner, and their lower ends are connected with the tops of the clamping blocks (52) through the openings in the upper ends of the fixing columns (56).

5. The electronic cigarette atomizer with the convenient-to-mount heating wire according to claim 4, wherein the fixing columns (56) and the mounting holes (51) are integrated with the base (5).

6. The electronic cigarette atomizer with the convenient-to-mount heating wire according to claim 1, wherein the oil storage atomization main body (1) comprises a top cover (11), a linking sleeve (12), an oil storage pipe (13) and a bottom cover (14), wherein the top cover (11) and the linking sleeve (12) are sequentially arranged at an upper end of the oil storage pipe (13) from top to bottom, the bottom cover (14) is arranged at a lower end of the oil storage pipe (13), its upper end is located in the oil storage pipe (13) and provided with an atomization cavity (141), and the atomization cavity (141) is communicated with an oil storage cavity (131) in the oil storage pipe (13) through a through hole (142) formed in a peripheral surface of the bottom cover (14); a lower end of the linking sleeve (12) is connected with the upper end of the bottom cover (14), and is communicated with the atomization cavity (141); the suction nozzle (2) is arranged at an upper end of the top cover (11), and penetrates through the top cover (11) to be communicated with the linking sleeve (12); and the base (4) is arranged at a lower end of the bottom cover (14), and its heating wire (4) and heating wire fixing seat (5) are located in the atomization cavity (141) of the bottom cover (14).

* * * * *